US009519242B2

(12) United States Patent
Furukawa

(10) Patent No.: US 9,519,242 B2
(45) Date of Patent: Dec. 13, 2016

(54) DEVELOPING APPARATUS AND IMAGE FORMING APPARATUS HAVING A CONVEYING MEMBER WITH MULTIPLE SCREW PORTIONS

(71) Applicant: CANON KABUSHIKI KAISHA, Tokyo (JP)

(72) Inventor: Mitsuhiro Furukawa, Kawaguchi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/507,084

(22) Filed: Oct. 6, 2014

(65) Prior Publication Data

US 2015/0125185 A1 May 7, 2015

(30) Foreign Application Priority Data

Nov. 1, 2013 (JP) ..... 2013-228475

(51) Int. Cl.
*G03G 15/08* (2006.01)
*G03G 15/09* (2006.01)

(52) U.S. Cl.
CPC ..... *G03G 15/0893* (2013.01); *G03G 15/09* (2013.01); *G03G 2215/0833* (2013.01)

(58) Field of Classification Search
CPC ..... G03G 15/0891; G03G 15/0889; G03G 15/0893; G03G 15/09; G03G 2215/0827; G03G 2215/083; G03G 2215/0833
See application file for complete search history.

(56) References Cited

U.S. PATENT DOCUMENTS 5,963,766 A * 10/1999 Okuno et al. ..... 399/256
2007/0098451 A1* 5/2007 Hart et al. ..... 399/256
2012/0070194 A1 3/2012 Okuno
(Continued)

FOREIGN PATENT DOCUMENTS

JP 05-333691 A 12/1993
JP 06-51634 A 2/1994
(Continued)

OTHER PUBLICATIONS

U.S. Appl. No. 14/524,015, M. Furukawa, filed Oct. 27, 2014.

*Primary Examiner* — David Gray
*Assistant Examiner* — Laura Roth
(74) *Attorney, Agent, or Firm* — Fitzpatrick, Cella, Harper & Scinto

(57) ABSTRACT

A developing apparatus includes a developer bearing member, a first conveying member disposed in a supplying chamber, a second conveying member disposed in a collecting chamber, and a third conveying member disposed in the collecting chamber to convey the developer in a conveying direction opposite to the conveying direction of the second conveying member. The third conveying member has a conveying performance which is lower than that of the second conveying member, and has a first screw portion including a spiral blade portion and a second screw portion including a spiral blade portion at a downstream side in the conveying direction The spiral blade portion of the first screw portion and the spiral blade portion of the second screw portion are formed to have a same spiral direction, and a conveying performance of the second screw portion is lower than a conveying performance of the first screw portion.

8 Claims, 11 Drawing Sheets

EXAMPLE 1-1

EXAMPLE 1-2

(56) References Cited

U.S. PATENT DOCUMENTS

| | | | | |
|---|---|---|---|---|
| 2012/0201574 | A1 | 8/2012 | Hayashi et al. | |
| 2013/0045029 | A1* | 2/2013 | Kimura et al. | 399/272 |
| 2013/0149011 | A1* | 6/2013 | Hayashida et al. | 399/263 |

FOREIGN PATENT DOCUMENTS

| | | | |
|---|---|---|---|
| JP | 3104722 | B2 | 10/2000 |
| JP | 3127594 | B2 | 1/2001 |
| JP | 2004279979 | A | 10/2004 |
| JP | 4079324 | B2 | 4/2008 |
| JP | 2011-242559 | A | 12/2011 |
| JP | 2012068317 | A | 4/2012 |
| JP | 2012163778 | A | 8/2012 |
| JP | 5251948 | B2 | 7/2013 |
| JP | 5286376 | B2 | 9/2013 |

* cited by examiner

FIG. 4A

| | NUMBER OF SCREW ROTATIONS | PITCH ON UPSTREAM SIDE | PITCH ON DOWNSTREAM SIDE | DIAMETER ON DOWNSTREAM SIDE | DEVELOPER LEAKAGE IN END PORTION | DEVELOPER OVERFLOWING |
|---|---|---|---|---|---|---|
| COMPARATIVE EXAMPLE 1 | 600rpm | 20mm | 20mm | 10mm | × | ◎ |
| COMPARATIVE EXAMPLE 2 | 300rpm | 20mm | 20mm | 10mm | ○ | × |
| COMPARATIVE EXAMPLE 3 | 600rpm | 20mm | NO BLADES | 10mm | ○ | × |

FIG. 4B

| | NUMBER OF SCREW ROTATIONS | PITCH ON UPSTREAM SIDE | PITCH ON DOWNSTREAM SIDE | DIAMETER ON DOWNSTREAM SIDE | DEVELOPER LEAKAGE IN END PORTION | DEVELOPER OVERFLOWING |
|---|---|---|---|---|---|---|
| EXAMPLE 1-1 | 600rpm | 20mm | 10mm | 10mm | ○ | ○ |
| EXAMPLE 1-2 | 600rpm | 20mm | 20mm | 7mm | ○ | ○ |
| EXAMPLE 1-3 | 600rpm | 20mm | 9.5-18.5mm | 10mm | ○ | ◎ |

FIG. 7

| | NUMBER OF SCREW ROTATIONS | PITCH ON UPSTREAM SIDE | PITCH ON DOWNSTREAM SIDE | DIAMETER ON DOWNSTREAM SIDE | OTHER SHAPES ON DOWNSTREAM SIDE | DEVELOPER LEAKAGE IN END PORTION | DEVELOPER OVERFLOWING |
|---|---|---|---|---|---|---|---|
| EXAMPLE 2-1 | 600rpm | 20mm | 20mm | 10mm | RIB | ○ | ◎ |
| EXAMPLE 2-2 | 600rpm | 20mm | 20mm | 10mm | TAPER | ○ | ◎ |
| EXAMPLE 2-3 | 600rpm | 20mm | 9.5-18.5mm | 10mm | RIB | ◎ | ◎ |
| EXAMPLE 2-4 | 600rpm | 20mm | 9.5-18.5mm | 10mm | TAPER | ◎ | ◎ |

δ 1= -30°

δ 2= -5°

DEVELOPING APPARATUS AND IMAGE FORMING APPARATUS HAVING A CONVEYING MEMBER WITH MULTIPLE SCREW PORTIONS

BACKGROUND OF THE INVENTION

Field of the Invention

The present invention relates to a developing apparatus and an image forming apparatus in which an electrophotographic system or an electrostatic recording system is employed to form an image.

Description of the Related Art

Conventionally, many image forming apparatuses employing the electrophotographic system or the electrostatic recording system use a two-component developer in which toner and carrier are mixed. In particular, a full-color image forming apparatus which forms a full-color image by the electrophotographic system uses the two-component developer from a viewpoint of a coloring property and a color mixing property.

A development method using the two-component developer is a method in which the toner is charged by frictional electrification between the carrier and the toner and the charged toner is attached to a latent image in an electrostatic manner to form an image.

In the development method using the two-component developer, it is important to stabilize a toner charging amount (hereinafter, referred to as a "tribo") in order to form an image while stabilizing the density within a slight variation. Therefore, it is necessary to make a density distribution of the toner in the developing apparatus uniformed.

In general, the tribo is easily influenced by the toner density. Further, when the toner density is decreased, an absolute value of the tribo tends to be increased, and when the toner density is increased, the absolute value of the tribo tends to be decreased.

Therefore, in a case where the toner is consumed during a developing operation and the toner density of the developer is lowered, the developing apparatus of the related art performs control such that the toner corresponding to the amount of the consumed toner is replenished and agitated to keep a constant amount of the toner density.

However, when the developer is used for a long time, the developer collected from a developing sleeve into the developing apparatus is not sufficiently mixed with the developer already in the developing apparatus during the developing operation, so that the toner density is unevenly distributed in part. Then, the collected developer is supplied to the developing sleeve again, and as a result there causes a problem in that the density is lowered.

As a countermeasure of the above problem, there is proposed a configuration in which when the toner is consumed during the developing operation, the developer comes to be in a state of low toner density, and thus the collected developer is not supplied to the developing sleeve at once. Specifically, a supplying chamber to supply the developer to the developing sleeve and a collecting chamber to collect the developer from the developing sleeve are divided. Therefore, the developer just collected to the developing apparatus is prevented from being supplied to the developing sleeve at once (see Japanese Patent Laid-Open No. 1993-333691). FIG. 10 is a diagram for describing a conventional example.

As illustrated in FIG. 10, the developing apparatus is provided with the supplying chamber in the upper portion of the developing apparatus and the collecting chamber in the lower portion thereof. The developer is circulated between the collecting chamber and the supplying chamber using a first conveying screw 101 and a second conveying screw 102 which are contrary to each other in the conveying direction. Then, while circulating the developer, the developer is supplied from the supplying chamber in the upper portion to the developing sleeve to perform development on a photosensitive member. On the other hand, after the development, the developer is collected from the developing sleeve into the collecting chamber in the lower portion. With this configuration, the developer of which the toner density is lowered after the development is not directly supplied to the developing sleeve. Therefore, the problem in that the toner density becomes partially uneven or the density is decreased is alleviated.

However, even in a case where such a developing apparatus is used, when a lot of toner is consumed such as a case where an image is printed at a high rate, there still remains the problem in that the uneven toner density is partially generated or the density is decreased.

The following reasons can be considered. First, the toner replenished into the developer and the developer collected from the developing sleeve are joined in the collecting chamber, agitated and conveyed. Herein, in an axial direction of the developing sleeve, in an area on a downstream side in the conveying direction of the collecting chamber near a communication portion through which the developer is transferred from the collecting chamber toward the supplying chamber, the developer collected from a developing portion and fallen into the collecting chamber is relatively readily transferred to the supplying chamber. Then, the developer fallen on an inner side of the collecting chamber is not sufficiently agitated with the developer replenished with the toner and thus not sufficiently mixed with each other, and in this state the developer is easily transferred to the supplying chamber.

The above problem is not significant in the case of a low printing rate, but when the toner is not sufficiently agitated in the case of a high printing rate, the developer having an uneven density is transferred to the supplying chamber. Therefore, there is a possibility to supply such developer to the developing sleeve.

Further, the developer is likely to remain on the inner side near the communication portion which transfers the developer from the collecting chamber to the supplying chamber on the downstream side of the second conveying screw 102. Then, when the amount of developer is increased or when the fluidity of the developer is lowered, there is a concern that the developer overflows to the outside of a development device.

As a countermeasure of the above problem, there is proposed a developing apparatus provided with a third conveying screw 103 which conveys the developer in a direction opposite to a conveying direction of the second conveying screw 102 in addition to the second conveying screw 102 in the collecting chamber (see Japanese Patent Laid-Open No. 1994-051634). FIG. 11 is a diagram for describing a conventional example.

As illustrated in FIG. 11, since the third conveying screw 103 is provided, the developer remained on an inner side near the communication portion which conveys the developer from the collecting chamber toward the supplying chamber can be pushed in a direction opposite to the conveying direction of the second conveying screw 102. Therefore, the developer bearing surface can be evenly formed, and the fallen developer can be more effectively agitated.

However, as in the configuration disclosed in Japanese Patent Laid-Open No. 1994-051634, in a configuration in which the developer overflowing toward the third conveying screw in the developer remained in the communication portion from the collecting chamber toward the supplying chamber is evenly conveyed in a longitudinal direction to be pushed, the developer in the downstream end portion of the third conveying screw may be leaked.

In other words, a conveyance force of the third conveying screw is increased in order to form the developer bearing surface evenly. However, on the other hand, when the conveyance force of the third conveying screw is too much increased, the developer is excessively conveyed to raise a developer pressure (a pressure applied onto the developer) in the downstream end portion of the third conveying screw. As a result, as described above, the leakage of the developer may occur.

Further, there is a configuration in which the blade of the third conveying screw is not provided in the whole area but up to the midway in the longitudinal direction in order to increase an assembly property. In this configuration, since the developer is not conveyed up to the downstream end portion, the developer leakage from the end portion does not occur. However, the developer remains in a boundary portion of the blade of the third conveying screw, and the developer may overflow from the position of the boundary portion.

SUMMARY OF THE INVENTION

It is desirable to prevent developer leakage and a developer overflowing while keeping an effective agitation of the developer and suppressing a deviation in the developer bearing surface in the collecting chamber.

A representative configuration of the present invention in order to achieve the above advantage is as follows. A developing apparatus includes a developer bearing member which carries and conveys a developer and develops a latent image formed on an image bearing member, a supplying chamber which is provided to face a part of a peripheral surface of the developer bearing member and supplies the developer to the developer bearing member, a collecting chamber which is provided to face a part of the peripheral surface of the developer bearing member, collects the developer from the developer bearing member, and forms a circulation path to the supplying chamber to circulate the developer, a first conveying member which is disposed in the supplying chamber and conveys the developer, a second conveying member which is disposed in the collecting chamber and conveys the developer in a direction opposite to a conveying direction of the first conveying member, and a third conveying member which is disposed in the collecting chamber and conveys the developer in a direction opposite to a conveying direction of the second conveying member, wherein the third conveying member has a conveyance performance on a downstream side lower than that on an upstream side in the conveying direction of the developer.

Further features of the present invention will become apparent from the following description of exemplary embodiments with reference to the attached drawings.

BRIEF DESCRIPTION OF THE DRAWINGS

FIGS. 4A and 4B are tables listing conditions and effects of the first embodiment;

FIG. 7 is a table listing conditions and effects of a second embodiment;

DESCRIPTION OF THE EMBODIMENTS

Hereinafter, embodiments of a developing apparatus and an image forming apparatus according to the invention will be described with reference to the accompanying drawings. In addition, the developing apparatus is used in the image forming apparatus as described below, but the invention is not limited thereto. Therefore, the image forming apparatus can be implemented without distinction of tandem type/one drum type or intermediate transfer type/direct transfer type, and also without distinction of two-component developer/one-component developer. In the embodiment, the description will be made only focusing on main parts relating to the configuration of forming a toner image. However, the invention can be implemented for the use of printers, various types of printing machines, copying machines, facsimiles, multifunction peripherals, and the like, including necessary mechanisms, apparatuses, and housing structures.

Figure 1:
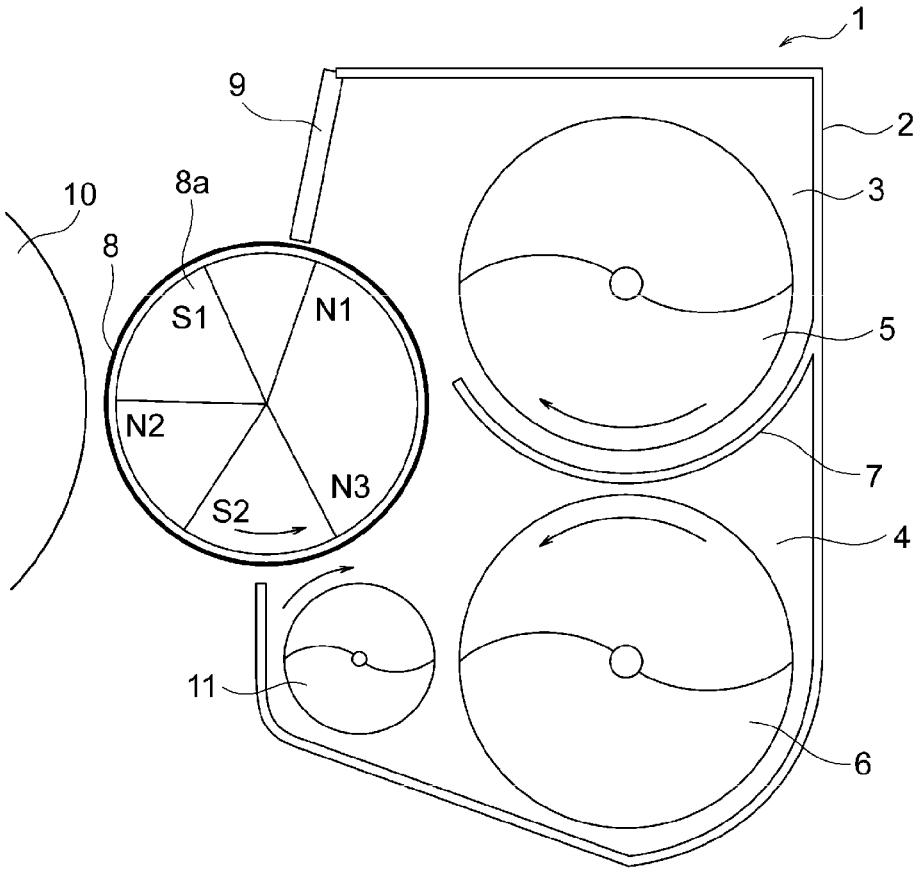
FIG. 1 is an enlarged cross-sectional view illustrating a developing apparatus of a first embodiment.

[First Embodiment] First, the developing apparatus will be described. FIG. 1 is an enlarged cross-sectional view illustrating a developing apparatus of a first embodiment. FIG. 1 illustrates a positional relation between a photosensitive drum 10 (an image bearing member) and a developing apparatus 1 in each of the stations Y, M, C, and K of a full-color image forming apparatus. The stations Y, M, C, and K have substantially the same configuration, and form images of Yellow (Y), Magenta (M), Cyan (C), Black (K) in a full-color image, respectively. In the following description, for example, the "developing apparatus 1" refers to commonly indicate a developing apparatus 1Y, a developing apparatus 1M, a developing apparatus 1C, and a developing apparatus 1K in the respective stations Y, M, C, and K as a representative.

Figure 2:
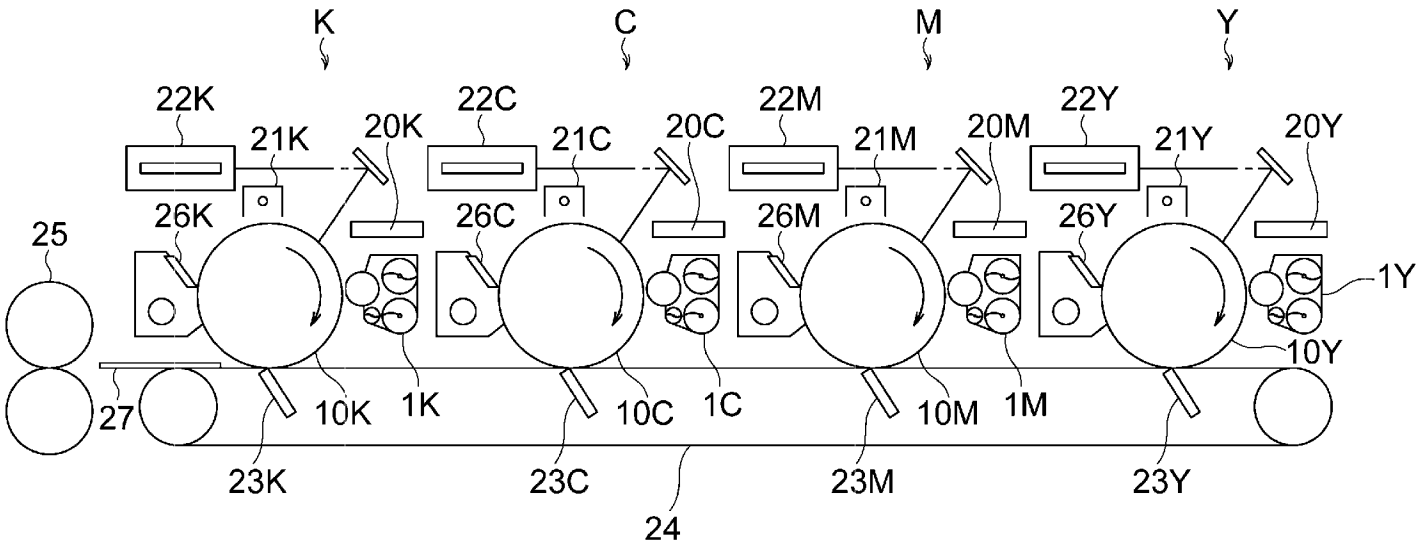
FIG. 2 is a schematic diagram illustrating a configuration of an image forming apparatus of the first embodiment.

The entire operation of the image forming apparatus will be described using FIGS. 1 and 2. FIG. 2 is a schematic diagram illustrating a configuration of the image forming apparatus of the first embodiment.

As illustrated in FIG. 2, the photosensitive drum 10 is provided to face the developing apparatus 1 to be freely rotated. In an image-forming period, first, the photosensitive drum 10 is evenly charged by a primary charger 21. Next, a laser beam is emitted by a light emitting element 22 for example. The laser beam is modulated according to an image information signal received from the outside and the photosensitive drum 10 is exposed to the laser light, so that an electrostatic latent image is formed. The electrostatic latent image is visualized as a development image (toner image) using toner supplied by the developing apparatus 1.

The toner image is transferred by a transfer charger 23 disposed in each station onto a transfer material 27 (a recording material) which is conveyed by a transfer material conveying belt 24. Then, the toner image is fixed onto the transfer material 27 by a fixing apparatus 25, and becomes a permanent image.

Transfer residual toner which is not transferred but left onto the photosensitive drum 10 is removed by a cleaning apparatus 26. While the toner is consumed from the developer as an image is formed, the toner is replenished to the developer from a toner replenishment tank 20 as much as the consumed amount. In addition, a process speed of the image forming apparatus is 300 mm/s.

In addition, in the embodiment, the toner image on the photosensitive drum 10 is directly transferred onto the transfer material 27 conveyed to the transfer material conveying belt 24, but the invention is not limited to this system. For example, the invention is applicable to an image forming apparatus in which an intermediate transfer member is provided instead of the transfer material conveying belt 24, and the toner images of the respective colors are primarily transferred from the photosensitive drums 10 of the respective colors to the intermediate transfer member, and then the combined toner images of the respective colors are secondarily transferred onto a transfer sheet in a collective manner.

<Two-component Developer> Next, a two-component developer which is used in the embodiment will be described.

The toner includes colored resin particles in which a binder resin, a colorant, and other additives if needed are contained, and colored particles to which an external additive such as colloidal silica fine powder is added. Then, the toner is a negatively-charged polyester resin. The toner in the embodiment has a volume average particle diameter of 7.0 μm.

As a carrier, for example, metal such as an iron having oxidized or non-oxidized surface, nickel, cobalt, manganese, chromium, rare-each metal, and an alloy of these materials, or a ferrite oxide can be used appropriately. A method of producing these magnetic particles is not particularly limited. The carrier in the embodiment is a ferrite carrier, and has an average particle diameter of 35 μm. Further, a weight percent of the carrier to the toner of the developer is 8%, and the developer in a developing container 2 has a weight of 300 g.

<Developing Apparatus> Next, the operation of the developing apparatus 1 will be described using FIG. 1.

The developing apparatus 1 includes a developing sleeve 8 (a developer bearing member) and a regulating blade 9 in the developing container 2. The developing container 2 contains the two-component developer which includes non-magnetic toner and magnetic carrier.

The regulating blade 9 is provided to face the developing sleeve 8, and regulates a thickness of the developer carried on the surface of the developing sleeve 8.

The substantially center portion of the developing container 2 is horizontally partitioned into a supplying chamber 3 and a collecting chamber 4 by a partition wall 7.

The supplying chamber 3 is provided to face a part of the peripheral surface of the developing sleeve 8, and supplies the developer to the developing sleeve 8 at a position facing the peripheral surface of the developing sleeve 8. Further, the collecting chamber 4 is provided to face a part of the peripheral surface of the developing sleeve 8, and collects the developer from the developing sleeve 8 at a position facing the peripheral surface of the developing sleeve 8.

The partition wall 7 is extended in a direction perpendicular to the sheet face of FIG. 1, and the developer is contained in the supplying chamber 3 and the collecting chamber 4.

The following agitating/conveying units are disposed in the supplying chamber 3 and the collecting chamber 4. Specifically, a first conveying screw 5 (a first conveying member) is disposed in the supplying chamber 3, and a second conveying screw 6 (a second conveying member) and a third conveying screw 11 (a third conveying member) are disposed in the collecting chamber 4.

The first conveying screw 5 is disposed along an axial direction of the developing sleeve 8 substantially parallel to the bottom of the supplying chamber 3, and rotates to convey the developer in the supplying chamber 3 directionally in the axial direction of the first conveying screw 5. The second conveying screw 6 is disposed above the bottom of the collecting chamber 4 substantially parallel to the first conveying screw 5, and conveys the developer in the collecting chamber 4 in a direction opposite to the first conveying screw 5. The third conveying screw 11 is disposed below the developing sleeve 8 in the collecting chamber 4 along the axial direction substantially parallel thereto, and conveys the developer in the collecting chamber 4 in a direction opposite to the second conveying screw 6.

In the embodiment, the first conveying screw 5 and the second conveying screw 6 have a screw structure in which an agitator blade having a non-magnetic material on the peripheral surface of a rotation shaft thereof is provided in a spiral shape. The first conveying screw 5 and the second conveying screw 6 is provided to have ϕ20 mm in diameter and 20 mm in pitch, and the rotation frequency is set to 600 rpm. The detailed configuration of the third conveying screw 11 will be described below.

An opening (a communication portion) is formed in both ends of the supplying chamber 3 and the collecting chamber 4 in a direction perpendicular to the sheet face of FIG. 1. Therefore, the developer in the developing container 2 circulates between the supplying chamber 3 and the collecting chamber 4 through the communication portion of the partition wall 7 while the first conveying screw 5, the second conveying screw 6, and the third conveying screw 11 rotate.

With the above-mentioned configuration, the developer in the supplying chamber 3 is conveyed while the first conveying screw 5 rotates, and is supplied to the developing sleeve 8 through an opening portion between the regulating blade 9 and the partition wall 7.

Further, an opening portion is formed in a developing area where the developing container 2 faces the photosensitive drum 10, and the developing sleeve 8 is partially exposed toward the photosensitive drum 10 through the opening portion. In the embodiment, a gap (SD gap) formed between the developing sleeve 8 and the photosensitive drum 10 is about 250 μm.

The developing sleeve 8 is formed of a non-magnetic material in which a magnet roller 8*a* (a magnetic field generation member) is disposed in an irrotational state. The magnet roller 8*a* includes a development pole (S2) and magnetic poles (S1, N1, N2, and N3) conveying the developer. Among these poles, a first magnetic pole N3 and a second magnetic pole N1 having the same polarity are disposed adjacent to each other in the developing container 2. Then, a repulsive magnetic field is formed between the poles, and the developer is separated from the surface of the developing sleeve 8 in the collecting chamber 4.

As illustrated in FIG. 1, the developing sleeve 8 rotates in a direction depicted by an arrow at the time of developing. In the developing container 2, the developer is formed in a brush shape (a so-called magnetic brush) on the surface of the developing sleeve 8.

The regulating blade 9 is disposed on an upstream side from the photosensitive drum 10 in a rotation direction of the developing sleeve 8. The regulating blade 9 is a non-magnetic member which is extended along the axis line in a longitudinal direction to face the developing sleeve 8 and is formed of aluminum or the like in a plate shape. The magnetic brush is cut off by the regulating blade 9, and the developer on the surface of the developing sleeve 8 is regulated in thickness.

Then, both the toner and the carrier of the developer pass through between a leading edge of the regulating blade 9 and the developing sleeve 8 and are sent to the developing area. In addition, the cutting-off amount of the magnetic brush of the developer carried on the developing sleeve 8 is regulated by adjusting the gap between the regulating blade 9 and the surface of the developing sleeve 8, so that the amount of developer to be conveyed to the developing area is adjusted. In the embodiment, the amount of developer coated per unit area on the developing sleeve 8 is regulated to be 30 mg/cm$^2$ by the regulating blade 9.

As described above, the developer regulated in thickness is conveyed to the developing area facing the photosensitive drum 10, and supplied onto the electrostatic latent image formed on the photosensitive drum 10. Therefore, the electrostatic latent image on the photosensitive drum 10 is developed.

Figure 3:
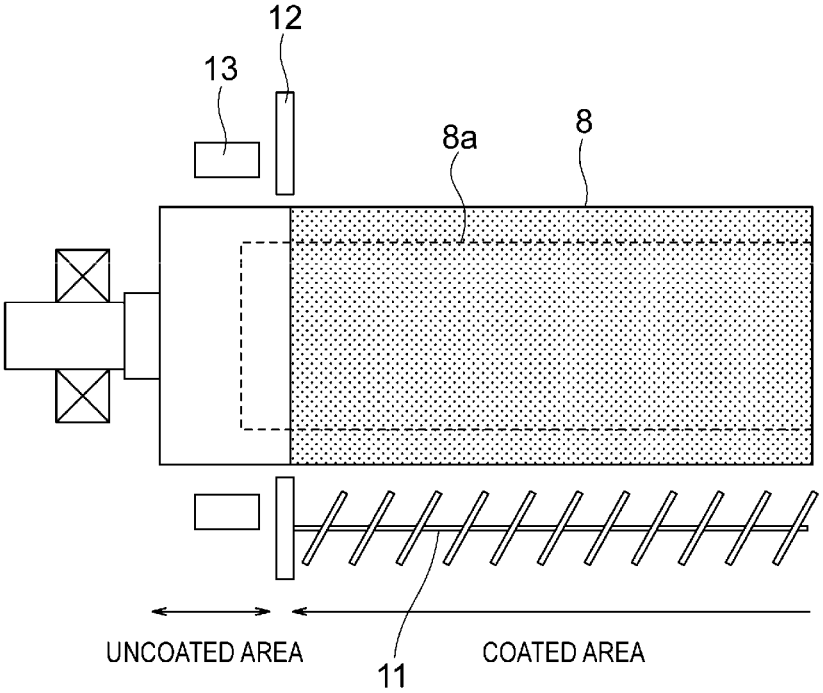
FIG. 3 is a diagram illustrating a configuration of an end portion of a developing container of the first embodiment.

<End Seal Configuration> A configuration of a magnetic seal relating to the invention will be described using FIG. 3. FIG. 3 is a diagram illustrating a configuration of an end portion of the developing container of the first embodiment.

As illustrated in FIG. 3, a magnetic plate 12 (a magnetic seal member) of the plate shape is disposed on both end portions of the developing sleeve 8 to surround the developing sleeve 8 in a non-contact manner. Therefore, magnetic brushes by the developer are formed between the magnet roller 8*a* in the developing sleeve 8 and the magnetic plate 12, and the gap formed between the developing sleeve 8 and the developing container 2 is closed. With this configuration, it is possible to suppress the developer from leaking to the longitudinal direction of the developing sleeve 8.

Further, in a case where there is an area having a weak magnetic force in a portion of the magnet roller 8*a* in a peripheral direction, the magnetic field lines become loosened, so that the magnetic brushes are not formed so much. In this case, the leakage of the developer will be a cause for concern. Herein, as in the embodiment, in a case where the poles having the same polarity are present adjacent to each other in the magnet roller 8*a*, the magnetic lines of force are not generated in the poles having the same polarity. Therefore, since the magnetic field lines of force on that area become loosened, there is a concern of the leakage.

In the embodiment, a magnet sheet 13 of a sheet shape is attached to the further outside (on a side near the end portion) of the magnetic plate 12 in a direction toward the end portion of the developing sleeve 8. Therefore, the leakage of the developer is further suppressed. Since the magnet sheet 13 is provided, the magnetic lines of force are generated between the magnet sheet 13 and the magnetic plate 12, and the magnetic brushes are formed. Therefore, the gap formed between the developing sleeve 8 and the magnetic plate 12 is closed, and the leaked developer is captured by the magnet sheet 13. Accordingly, it is possible to suppress the developer from leaking in the longitudinal direction.

<Third Conveying Screw> Hereinafter, the detailed configuration of the third conveying screw 11 will be described.

The third conveying screw 11 has a screw structure in which an agitator blade having a non-magnetic material on the peripheral surface of a rotation shaft thereof is provided in a spiral shape. A screw diameter of the third conveying screw 11 of the embodiment is ϕ10 mm, and the rotation frequency is set to 600 rpm.

As to be described below, the configuration of the agitator blade of the third conveying screw 11 is different on its upstream side and downstream side. A conveyance performance of the developer on the downstream side is set to be lowered compared to that on the upstream side in a conveying direction of the developer. For example, the pitch of the agitator blade in the half portion on the upstream side in the longitudinal direction is set to 20 mm, and the pitch of the agitator blade in the half portion on the downstream side is set to 10 mm in short. Specifically, as to be described in detail below, while comparing examples which are specific examples of the embodiment with comparative examples of a typical agitator blade, the configuration of the embodiment and the advantages will be reviewed and described.

In reviewing, there has been used a specific apparatus which can confirm the circulating of the developer while rotating the developing sleeve and the conveying screws. While changing the shape of the third conveying screw 11, developer leakage in the downstream end portion of the third conveying screw (hereinafter, simply referred to as the "downstream end portion") and developer overflowing of the developer from the developing container 2 which are a task of the invention have been reviewed.

The amount of developer in the developing container 2 was set to 300 g as a normal condition, and 600 g as a stress condition for applying a load. Under these conditions, the developer is circulated.

The conditions of the third conveying screw 11 are listed in FIGS. 4A and 4B. FIGS. 4A and 4B are tables listing conditions and effects of the first embodiment. FIG. 4A illustrates the comparative examples, and FIG. 4B illustrates the examples of the invention.

Under these conditions, after rotating the third conveying screw 11 for 10 hours, the developer leakage in the downstream end portion and the developer overflowing were checked. In FIGS. 4A and 4B, in a case where there was no problem found in the amount of developer under the normal condition, it was marked with "○", and in a case where there was no problem found in the amount of developer even under the stress condition, it was marked with "◎". Next, the specific configuration of FIGS. 4A and 4B will be described with reference to the drawings.

Figure 5A:
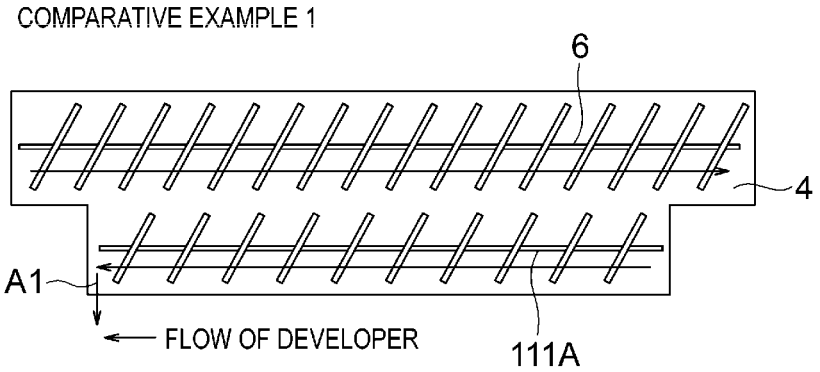
FIGS. 5A to 5C are schematic diagrams illustrating configurations of third conveying screws of comparative examples.
Figure 5B:
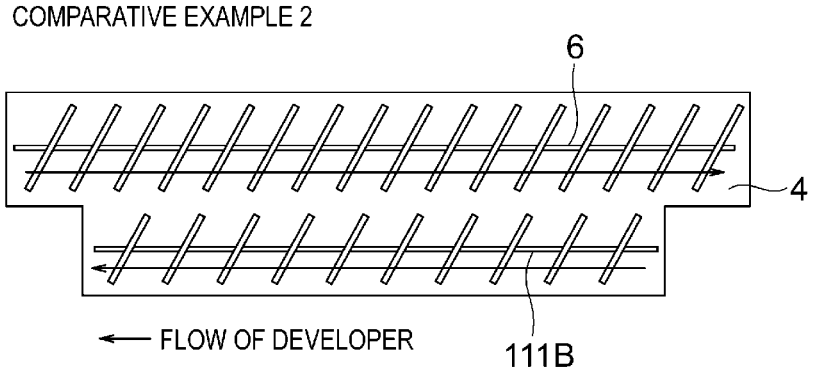
Figure 5C:
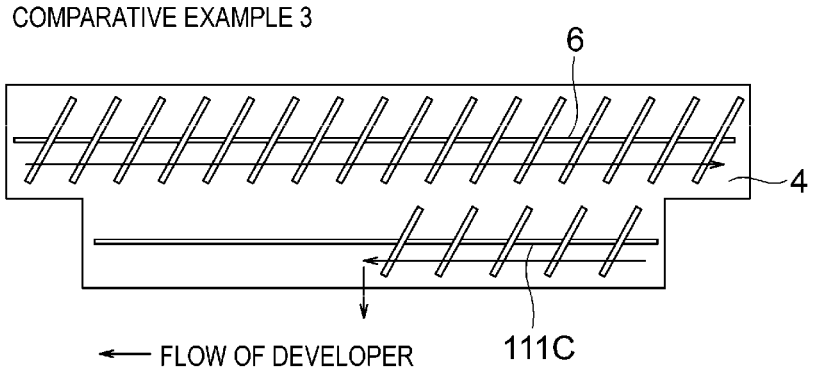

[Description of Comparative Examples] First, for the sake of comparison with the configuration of the third conveying screw 11 according to an example which is an aspect of the embodiment, the configurations of third conveying screws 111 according to the comparative examples and the tasks for the respective configurations will be described. FIGS. 5A to 5C are schematic diagrams illustrating the configurations of the comparative examples of the third conveying screw.

As illustrated in FIG. 5A, a third conveying screw 111A of Comparative example 1 was configured to have the same pitch of the agitator blade of 20 mm on both the upstream side and the downstream side. In Comparative example 1, the developer overflowing did not occur, but the developer leakage in the downstream end portion occurred under a condition that the amount of developer is 300 g.

The developer collected from the developing sleeve 8 is conveyed from the upstream side to the downstream side of the third conveying screw 111. Herein, when the developer arrived at the downstream end portion is pushed to the wall on the end portion, a developer pressure rises. Then, when the third conveying screw 111 is rotated under no load for a long time in the state of the raised developer pressure, a part of the developer gradually leaks to the outside from the development device (see arrow A1 in the drawing).

As illustrated in FIG. 5B, a third conveying screw 111B of Comparative example 2 was set to 300 rpm in its rotation frequency without changing the shape of the agitator blade. When the rotation frequency was set to be small, it was possible to suppress a rise in the developer pressure at the downstream end portion in the conveying direction of the developer. However, since the rotation frequency of the screw was fallen, the conveyance performance was degraded, so that the developer overflowing occurred.

As illustrated in FIG. 5C, a third conveying screw 111C of Comparative example 3 was configured such that the blades in a downstream portion were removed. In this configuration, the developer leakage in the downstream end portion did not occur, but the developer overflowing occurred in the boundary between the blade portion and the no-blade portion.

Figure 6A:
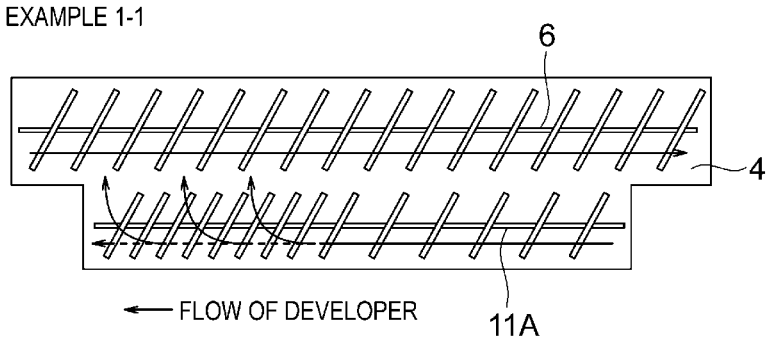
FIGS. 6A to 6C are schematic diagrams illustrating configurations of examples of a third conveying screw of the first embodiment.
Figure 6B:
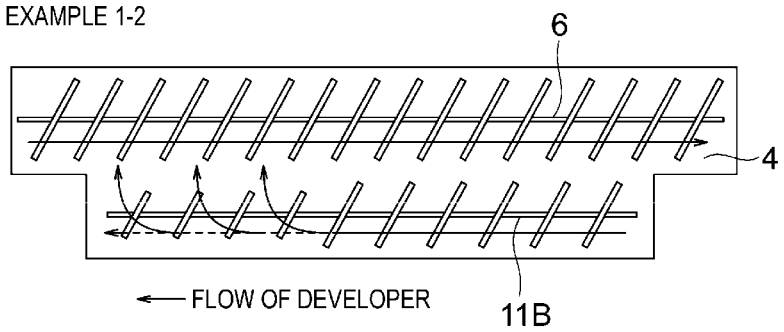
Figure 6C:
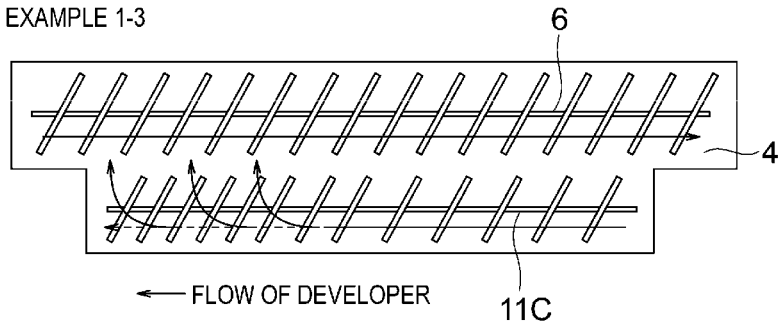

[Description of Example] Next, the third conveying screws 11 relating to examples which are an aspect of the embodiment will be described. FIGS. 6A to 6C are schematic diagrams illustrating configurations of examples of the third conveying screw of the first embodiment.

As illustrated in FIG. 6A, a third conveying screw 11A of Example 1-1 was configured such that the agitator blade of an upstream portion in the conveying direction of the developer was made to be 20 mm in pitch, and the agitator blade of the downstream portion was made to be 10 mm in pitch. In this way, as a result of making the agitator blade of the downstream portion short compared to the upstream portion, neither the developer leakage nor the developer overflowing was caused under a condition of the 300 g amount of developer.

With the configuration of Example 1-1, the conveyance performance of the developer is suppressed on the downstream side of the third conveying screw 11A. Thus, before arriving at the downstream end portion, the developer in the upstream portion is taken over from the third conveying screw 11A toward the second conveying screw 6. Therefore, it is considered that the developer pressure in the downstream end portion of the third conveying screw 11A is lowered and the developer leakage in the downstream end portion is suppressed.

As illustrated in FIG. 6B, a third conveying screw 11B of Example 1-2 was configured such that the screw diameter of the downstream portion was made smaller than that of the upstream portion without changing the pitch of the agitator blade in both the upstream portion and the downstream portion. Specifically, the screw diameter of the downstream portion was made to be 7 mm while the screw diameter of the upstream portion was 10 mm.

With the configuration of Example 1-2, the developer leakage in the downstream end portion was effectively suppressed by suppressing the developer pressure in the downstream end portion in the conveying direction of the third conveying screw 11B.

As illustrated in FIG. 6C, a third conveying screw 11C of Example 1-3 was configured such that the agitator blade of the upstream portion was 20 mm in pitch while the agitator blade of the downstream portion was made to be shortened in pitch from 18.5 mm to 9.5 mm by 1.5 mm in a stepped manner.

With the configuration of Example 1-3, since the conveyance performance of the developer became lowered in a stepped manner from the upstream portion to the downstream portion, even in a case where the amount of developer in the developing container 2 was 600 g, the developer overflowing did not occur.

In the respective shapes of Example 1, when the amount of developer in the developing container 2 was 300 g as the normal condition, it was possible to prevent the developer leakage and the developer overflowing of the downstream end portion. Further, even when the amount of developer in the developing container 2 was 600 g as the stress condition, it was possible to reliably reduce the developer leakage and the developer overflowing in the downstream end portion.

[Second Embodiment] Next, the second embodiment will be described. In addition, basic configurations and operations of an image forming apparatus of the embodiment are the same as those of the first embodiment. Therefore, the components having the same or equivalent function or configuration will be denoted by the same reference numerals, and the detailed descriptions thereof will not be repeated. The features of the embodiment will be described below.

In the first embodiment, the conveyance performance in the downstream portion in a longitudinal direction of the third conveying screw 11 has been suppressed with respect to the upstream portion. With this configuration, the developer overflowing does not occur and the developer leakage in the downstream end portion can be reduced. However, considering that a lot of developer is conveyed to the downstream end portion of the third conveying screw 11 under the stress condition, it is desirable to provide a structure capable of making the developer leakage further reduced. Therefore, the third conveying screw 11 of the embodiment has the following structure.

FIG. 7 is a table listing conditions and effects of the second embodiment. FIGS. 8A to 8D are schematic diagrams illustrating configurations of examples of the third conveying screw of the second embodiment.

Figure 8A:
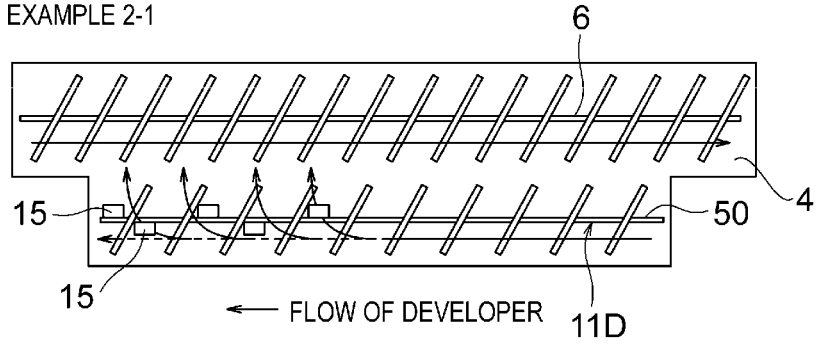
FIGS. 8A to 8D are schematic diagrams illustrating configurations of examples of a third conveying screw of the second embodiment.

As illustrated in FIG. 8A, a third conveying screw 11D of Example 2-1 includes a rib 15 of a paddle shape which is erected in the downstream portion. In the downstream portion of the third conveying screw 11D, the rib 15 is erected in the rotation shaft between the agitator blades, so that the developer can be actively taken over from the third conveying screw 11D toward the second conveying screw 6.

Figure 8B:
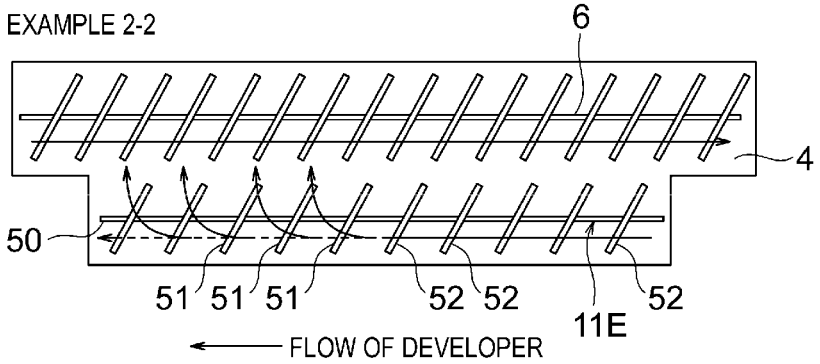

As illustrated in FIG. 8B, a third conveying screw 11E of Example 2-2 is configured such that an angle formed between the cross section of an agitator blade 51 of the downstream portion and a rotation shaft 50 is different from an angle formed between the cross section of an agitator blade 52 of the upstream portion and the rotation shaft 50.

Figure 9A:
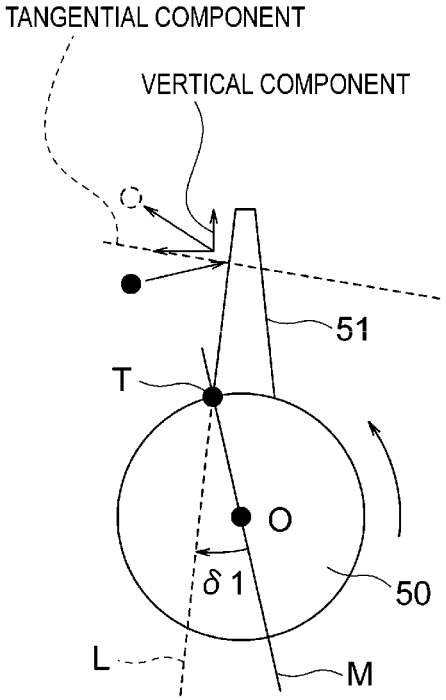
FIGS. 9A and 9B are cross-sectional views illustrating configurations of examples of the third conveying screw of the second embodiment.
Figure 9B:
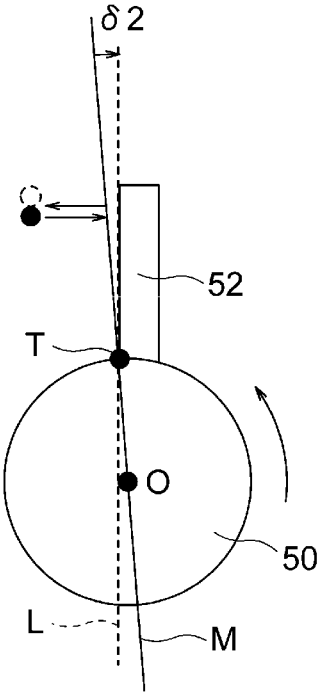
Figure 10:
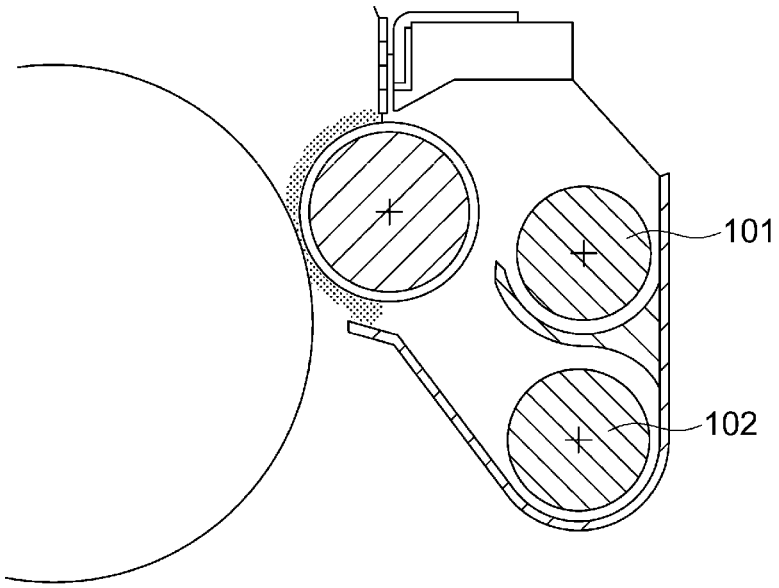
FIG. 10 is a diagram for describing a conventional example.
Figure 11:
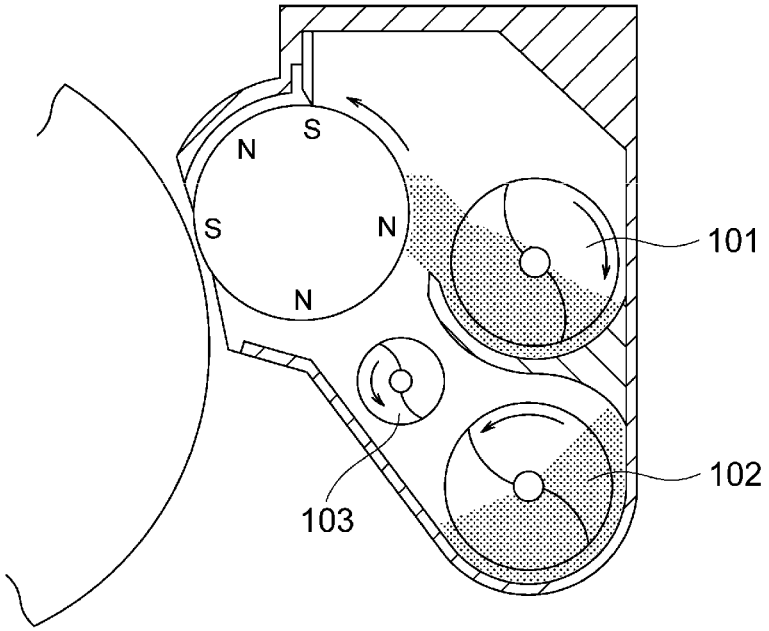
FIG. 11 is a diagram for describing a conventional example.

The cross-sectional structure of the agitator blade of Example 2-2 will be described in detail using FIGS. 9A and 9B. FIGS. 9A and 9B are cross-sectional views illustrating configurations of examples of the third conveying screw of the second embodiment, in which FIG. 9A illustrates a cross-sectional view of the agitator blade 51 of the downstream portion and FIG. 9B illustrates a cross-sectional view of the agitator blade 52 of the upstream portion.

In FIGS. 9A and 9B, a line segment L (the broken line in the drawing) is a line segment obtained when the faces of the agitator blade 51 and the agitator blade 52 of the third conveying screw 11E facing the developer intersect with a plane (the sheet face of FIGS. 9A and 9B) perpendicular to the conveying direction of the developer. Further, a straight line M is a straight line (a reference line) which passes through an intersection between a rotation shaft 50 of the third conveying screw 11E and the axial center O of the third conveying screw 11. Then, when viewed from a point T at which the line segment L and the straight line M intersect with each other, a rotation direction of the third conveying screw 11E is set as a positive direction, and an angle formed between the line segment L and the straight line M is denoted by δ.

Then, the third conveying screw 11E of Example 2-2 is configured such that the angle of the agitator blade 51 of the downstream portion is set to −30° (δ1=−30°) (see FIG. 9A). On the other hand, the angle of the agitator blade 52 of the upstream portion is set to −5° (δ2=−5°) (see FIG. 9B). In other words, when the rotation direction of the conveying member is assumed as a positive direction, the angles δ formed between the line segment L and the straight line M with the point T as a reference satisfy a relation of $\delta 1<\delta 2<0$.

When the face of the agitator blade is formed as a slope (that is, a taper shape) as the agitator blade 51 of the downstream portion, a vertical component (see FIG. 9A) of a conveying direction of the developer after colliding with the agitator blade can be made large. In other words, by making an absolute value of the angle δ formed between the face of the agitator blade 51 and the face passing the axial center of the rotation shaft 50, the developer is easily conveyed further away in a radial direction of the rotation shaft 50. Therefore, it is possible to accelerate the developer to be taken over toward the second conveying screw 6 of the developer.

On the other hand, a tangential component in FIG. 9A and the conveyance performance of the developer with respect to the longitudinal direction are reduced. Therefore, in the conveying direction of the developer of the third conveying screw 11E, the conveyance performance in the conveying direction of the developer in the downstream portion can be suppressed more than that of the upstream portion.

Figure 8C:
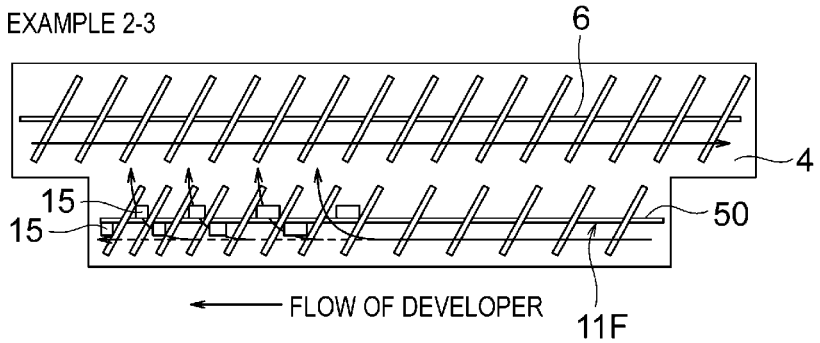

As illustrated in FIG. 8C, a third conveying screw 11F of Example 2-3 is configured such that the agitator blade of the downstream portion is made to be shortened in pitch from 18.5 mm to 9.5 mm by 1.5 mm in a stepped manner. Further, the agitator blade of the downstream portion of the third conveying screw 11F is provided with the rib 15 which is erected in the rotation shaft 50.

Figure 8D:
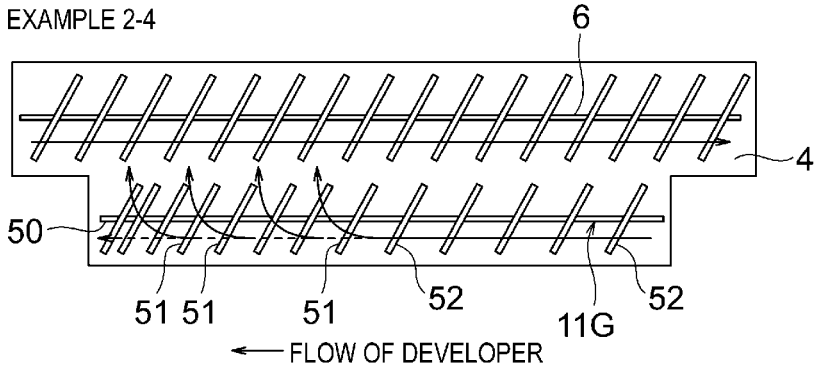

As illustrated in FIG. 8D, a third conveying screw 11G of Example 2-4 is similarly configured such that the agitator blade of the downstream portion is made to be shortened in pitch from 18.5 mm to 9.5 mm by 1.5 mm in a stepped manner. Further, the agitator blade 51 of the downstream portion of the third conveying screw 11G is formed in the same taper shape as that of Example 2-2 illustrated in FIGS. 9A and 9B.

In Examples 2-3 and 2-4, even when the amount of developer was 600 g under the stress condition, the developer leakage and the developer overflowing in the downstream end portion did not occur. In the embodiment, the configuration has been made to actively take over the developer toward the second conveying screw as well as the conveyance performance to the longitudinal direction is reduced on the downstream side. Therefore, the developer is unlikely to arrive at the downstream end portion, so that it is possible to reduce the developer pressure in the downstream end portion.

In addition, the above-mentioned third conveying screw 11 is not limited to the above configuration. The third conveying screw may be configured by any combination of a screw pitch, a screw diameter, a rib, and a taper.

In this example, the description has been made about the configuration in which the developing apparatus is horizontally partitioned into the supplying chamber and the collecting chamber as an example, but the supplying chamber and the collecting chamber may be disposed alongside each other in the horizontal direction. Further, the supplying chamber and the collecting chamber may be obliquely juxtaposed with each other.

With the above configuration, it is possible to prevent the developer leakage and the developer overflowing while keeping the agitation effect of the developer.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2013-228475, filed Nov. 1, 2013, which is hereby incorporated by reference herein in its entirety.

What is claimed is:

1. A developing apparatus comprising:

a developer bearing member which carries and conveys a developer and develops a latent image formed on an image bearing member;

a supplying chamber which is disposed along an axial direction of the developer bearing member and supplies the developer to the developer bearing member;

a collecting chamber which is disposed along the axial direction of the developer bearing member, and collects the developer supplied to the developer bearing member, the collecting chamber forming a circulation path with the supplying chamber to circulate the developer, wherein the developer supplied to the developer bearing member is collected in the collecting chamber before being collected in the supplying chamber;

a first conveying member which is disposed in the supplying chamber and conveys the developer along the supplying chamber;

a second conveying member which is disposed in the collecting chamber and conveys the developer in a conveying direction opposite to a conveying direction of the first conveying member; and a third conveying member which is disposed in the collecting chamber and conveys the developer in a conveying direction opposite to the conveying direction of the second conveying member, the third conveying member having a conveying performance which is lower than that of the second conveying member, wherein the third conveying member is disposed corresponding to a coated area of the developer bearing member with respect to a longitudinal direction of the third conveying member, wherein the third conveying member is directly opposed to the second conveying member for an entire longitudinal area of the third conveying member without a partition wall between the third conveying member and the second conveying member, and the developer is free to move directly from the third conveying member to the second conveying member, wherein the third conveying member has a first screw portion including a spiral blade portion and a second screw portion including a spiral blade portion, the second screw portion being disposed at a downstream side in the conveying direction of the third conveying member with respect to the first screw portion, and wherein the spiral blade portion of the first screw portion and the spiral blade portion of the second screw portion are formed to have a same spiral direction, and a conveying performance of the second screw portion is lower than a conveying performance of the first screw portion.

2. The developing apparatus according to claim 1, wherein the third conveying member is configured such that an agitator blade has a screw structure and a downstream portion of the agitator blade has a pitch narrower than that of an upstream portion.

3. The developing apparatus according to claim 1, wherein the third conveying member is configured such that an agitator blade has a screw structure and a downstream portion of the agitator blade has a screw diameter smaller than that of an upstream portion.

4. The developing apparatus according to claim 1, wherein the third conveying member is configured such that an agitator blade has a screw structure and is provided with a rib in a downstream portion of a rotation shaft of the agitator blade.

5. An image forming apparatus comprising:

an image bearing member which forms an electrostatic latent image; and the developing apparatus according to any one of claims 1 to 4 which supplies toner to the electrostatic latent image.

6. The developing apparatus according to claim 1, wherein the rotational axis of the third conveying member is closer to the developer bearing member than the rotational axis of the second conveying member.

7. The developing apparatus according to claim 1, wherein the second conveying member is configured to have an agitator blade with a first screw structure and the third conveying member is configured to have an agitator blade with a second screw structure, with a screw diameter of the second screw structure being smaller than a screw diameter of the first screw structure.

8. The developing apparatus according to claim 1, further comprising a partition wall provided between the first conveying member and the second conveying member, with a communication portion for circulating the developer between the collecting chamber and the supplying chamber being provided on the partition wall, wherein developer on the circulation path circulates between the collecting chamber and the supplying chamber via the communication portion.

* * * * *